US007901027B2

(12) United States Patent
Sugiura

(10) Patent No.: US 7,901,027 B2
(45) Date of Patent: Mar. 8, 2011

(54) IMAGE FORMING APPARATUS, COMPONENT, COMPONENT CHECKING METHOD, CONTROL PROGRAM, AND STORAGE MEDIUM

(75) Inventor: Hiroaki Sugiura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 77 days.

(21) Appl. No.: 12/175,916

(22) Filed: Jul. 18, 2008

(65) Prior Publication Data

US 2008/0279568 A1 Nov. 13, 2008

Related U.S. Application Data

(62) Division of application No. 11/470,697, filed on Sep. 7, 2006, now Pat. No. 7,731,323.

(30) Foreign Application Priority Data

Sep. 8, 2005 (JP) ..... 2005-260871

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 5,184,178 | A | 2/1993 | Takayanagi et al. | 399/16 |
| 6,371,586 | B1 | 4/2002 | Saruta | 347/7 |
| 6,385,407 | B1 | 5/2002 | Inose | |
| 6,488,352 | B1 * | 12/2002 | Helterline et al. | 347/19 |
| 6,722,753 | B2 * | 4/2004 | Helterline et al. | 347/19 |
| 2002/0075344 | A1 | 6/2002 | Usui et al. | |

FOREIGN PATENT DOCUMENTS

| | | |
|---|---|---|
| JP | 2000-246921 | 9/2000 |
| JP | 2002-111943 A | 4/2002 |
| JP | 2002-120438 A | 4/2002 |
| JP | 2002-225307 | 8/2002 |
| JP | 2002-333800 A | 11/2002 |
| JP | 2003-326752 A | 11/2003 |
| JP | 2005-227681 A | 8/2005 |

OTHER PUBLICATIONS

Japanese Office Action issued Aug. 26, 2010, in counterpart Japanese patent application No. 2005-260871.

* cited by examiner

*Primary Examiner* — Matthew Luu
*Assistant Examiner* — Brian J Goldberg
(74) *Attorney, Agent, or Firm* — Fitzpatrick, Cella, Harper & Scinto

(57) ABSTRACT

With this invention, compatibility between an image forming apparatus and a component mounted on the image forming apparatus is precisely checked. A cartridge, as the component, stores its ID (first information) and an ID (second information) of the image forming apparatus that can use the cartridge. The image forming apparatus stores its ID (third information) and an ID (fourth information) of the cartridge that can be used in the image forming apparatus. Then, when the fourth information includes the first information or the second information includes the third information, it is decided that the cartridge mounted in the image forming apparatus can be used. When the fourth information does not include the first information and the second information does not include the third information, it is decided that the cartridge mounted in the image forming apparatus cannot be used.

7 Claims, 8 Drawing Sheets

IMAGE FORMING APPARATUS, COMPONENT, COMPONENT CHECKING METHOD, CONTROL PROGRAM, AND STORAGE MEDIUM

This is application is a division of U.S. patent application Ser. No. 11/470,697, filed Sep. 7, 2006.

BACKGROUND OF THE INVENTION

1. Field of the Invention

The present invention relates to an image forming apparatus and a component used on the image forming apparatus. The present invention also relates to a component checking method to decide whether the component is available for use with the image forming apparatus, a control program to cause a computer to execute the checking method, and storage medium to store the control program.

2. Description of the Related Art

Generally, image forming apparatus (printing apparatus), such as ink jet printers, have replaceably mounted on their bodies cartridge type components that accommodate consumables, such as ink and print medium (also referred to simply as "cartridges"). Such cartridges are available on the market separate from the image forming apparatus body. Since new products of the image forming apparatus are introduced into the market in a short cycle of every year or half, few improvements on their performances are made after they have been put on the market. Cartridges, on the other hand, continue to be supplied as long as the image forming apparatus using the cartridges are in common use and thus continue to be manufactured and sold for a far longer period than with the image forming apparatus, for example, for more than 10 years. Since the cartridges continue to be manufactured and sold for many years, not a few improvements are made during that period. For example, when a new ink is developed and a cartridge (ink cartridge) accommodating that ink is put on the market, it is often the case that the new cartridge is designed to be able to be used also on old image forming apparatus that were sold in the past so that smooth transition from old cartridges can be made.

It is, however, often difficult to design new cartridges to match all image forming apparatus that were using old cartridges. For example, if the image forming apparatus is an ink jet printer, designing an ink ejection control and a recovery device for preventing possible clogging of ink ejection nozzles in a way that match new cartridges is difficult to achieve. Further, since the new cartridge needs to be able to be installed in the image forming apparatus that were sold in the past, new consumables cannot be changed in their shape from old ones.

As a technology to solve these problems, Japanese Patent Application Laid-open No. 2000-246921 describes a method of storing in the cartridge and using ID (identification) information. That is, the image forming apparatus checks the ID information stored in the cartridge to prevent an inappropriate cartridge from being mounted on the apparatus. Japanese Patent Application Laid-open No. 2002-225307 discloses a method for storing in the cartridge and using driver information that matches the cartridge. That is, by checking the match or compatibility between the driver information stored in the cartridge and the printer driver in the image forming apparatus, an inappropriate cartridge is prevented from being mounted and used on the image forming apparatus. Further, specifying and using a particular printer driver that match the driver information allows the new cartridge to be used correctly even in the image forming apparatus that were sold in the past.

However, with the method described in the Japanese Patent Application Laid-open No. 2000-246921, the image forming apparatus that were sold in the past cannot identify ID information of the new cartridge correctly. Further, in the case of the method described in Japanese Patent Application Laid-open No. 2002-225307, the image forming apparatus sold in the past can correctly identify the new cartridge by checking the driver information against the printer driver. This, however, requires a computer (host device) installed with a printer driver to communicate with the image forming apparatus. In recent years, image forming apparatus are available that are directly connected with a digital camera to print images taken by the digital camera without using the computer. Further, multifunction type image forming apparatus are commonly available which has multiple functions, such as a scanner function, a facsimile function and a copy function. The method disclosed in Japanese Patent Application Laid-open No. 2002-225307 that requires the use of a computer, however, cannot be applied to these image forming apparatus that do not require a computer.

SUMMARY OF THE INVENTION

An object of this invention is to provide an image forming apparatus capable of correctly checking a compatibility between the image forming apparatus and a component that can be mounted on the apparatus, a component, a functional component checking method, a control program, and storage medium.

In the first aspect of the present invention, there is provided an image forming apparatus using a mountable component to realize a desired function, comprising:

a mounting portion for mounting the component preliminarily provided with first information as its identification information and second information as identification information of at least one image forming apparatus that can use the component;

storage means for storing third information as identification information of the image forming apparatus and fourth information as identification information of at least one component that can be used on the image forming apparatus;

recognizing means for recognizing the first and second information provided to the component mounted on the image forming apparatus; and decision means for deciding that, when the fourth information includes the first information or when the second information includes the third information, the component mounted on the image forming apparatus can be used, and deciding that, when the fourth information does not include the first information and the second information does not include the third information, the component mounted on the image forming apparatus cannot be used.

In the second aspect of the present invention, there is provided a component mounted and used in an image forming apparatus recognizing first and second information provided in the component and storing third and fourth information, the third information being identification information of the image forming apparatus, the fourth information being identification information of at least one component that can be used on the image forming apparatus, wherein the component is preliminarily provided with its identification information as the first information and identification information of at least one image forming apparatus that can use the component as second information; wherein, when the component can be used in the image forming apparatus, the first information is included in the fourth information or the second information includes the third information; wherein, when the component cannot be used in the image forming apparatus, the first information is not included in the fourth information and the second information does not include the third information.

In the third aspect of the present invention, there is provided a decision method to check if a component mounted in an image forming apparatus can be used in the image forming apparatus, the method comprising the steps of:

recognizing first and second information provided to the component, the first information being identification information of the component and the second information being identification information of at least one image forming apparatus that can use the component;

comparing the first and second information with third and fourth information stored in the image forming apparatus, the third information being identification information of the image forming apparatus and the fourth information being identification information of at least one component that can be used in the image forming apparatus;

deciding that, when the fourth information includes the first information or when the second information includes the third information, the component mounted on the image forming apparatus can be used; and deciding that, when the fourth information does not include the first information and the second information does not include the third information, the component mounted on the image forming apparatus cannot be used.

In the fourth aspect of the present invention, there is provided a control program to check if a component mounted on an image forming apparatus can be used or not, the control program causing a computer to execute the steps of:

recognizing first and second information provided to the component, the first information being identification information of the component and the second information being identification information of at least one image forming apparatus that can use the component;

comparing the first and second information with third and fourth information stored in the image forming apparatus, the third information being identification information of the image forming apparatus and the fourth information being identification information of at least one component that can be used in the image forming apparatus;

deciding that, when the fourth information includes the first information or when the second information includes the third information, the component mounted on the image forming apparatus can be used and deciding that, when the fourth information does not include the first information and the second information does not include the third information, the component mounted on the image forming apparatus cannot be used.

In the fifth aspect of the present invention, there is provided a storage medium storing computer-readable program codes, wherein the storage medium stores the control program of the fourth aspect of the present invention.

With this invention, the component stores its identification information (first information) and identification information (second information) of at least one image forming apparatus that can use the component. The image forming apparatus stores its identification information (third information) and identification information (fourth information) of at least one component that can be used in the image forming apparatus. Then, when the fourth information includes the first information or the second information includes the third information, it is decided that the component mounted in the image forming apparatus can be used. When the fourth information does not include the first information and the second information does not include the third information, it is decided that the component mounted on the image forming apparatus cannot be used.

As described above, this invention compares the first and second information stored in the component with the third and fourth information stored in the image forming apparatus. This makes it possible to precisely check the compatibility between the image forming apparatus and the component that can be installed in the apparatus. Further, by putting the identification information of the image forming apparatus that were sold in the past in the second information stored in a component that is newly manufactured and marketed, the image forming apparatus capable of using the component can be set freely and correctly without having to modify the image forming apparatus at all.

Further features of the present invention will become apparent from the following description of exemplary embodiments (with reference to the attached drawings).

DESCRIPTION OF THE EMBODIMENTS

Now, embodiments of the present invention will be described by referring to the accompanying drawings. It should be noted that concepts included in the following embodiments may not necessarily be described in the scope of claims. Such concepts, however, are not deliberately excluded from the technical scope of the invention and may be in an equal relationship with the invention.

First Embodiment

As a first embodiment of this invention, a case will be described in which a cartridge (ink cartridge) accommodating ink is mounted as a component on an image forming apparatus (printing apparatus) that forms an image using ink. It is noted, however, that this invention does not limit the number of cartridges mounted on the image forming apparatus to only one. The cartridge is not limited to only those ink cartridges containing ink but may be those accommodating a variety of kinds of consumables, such as print medium. The cartridge is only one form of the component and may be storage medium storing programs and data used on the image forming apparatus.

Among ink cartridges that may be mounted on the image forming apparatus, there is a 2-cartridge type that separately accommodates a black (K) ink and color inks such as cyan (C), magenta (M) and yellow (Y) inks. An individual type ink cartridge is also available which individually and separately accommodates all C, M, Y and K inks and other inks. Whatever the type of ink cartridges, the image forming apparatus normally does not perform an image forming operation unless all the ink cartridges mounted are usable. Therefore, in an image forming apparatus in which a plurality of ink cartridges are installed, processing described later is executed for all ink cartridges and, only if all the ink cartridges are found to be usable, can the image forming apparatus operate normally.

Figure 8:
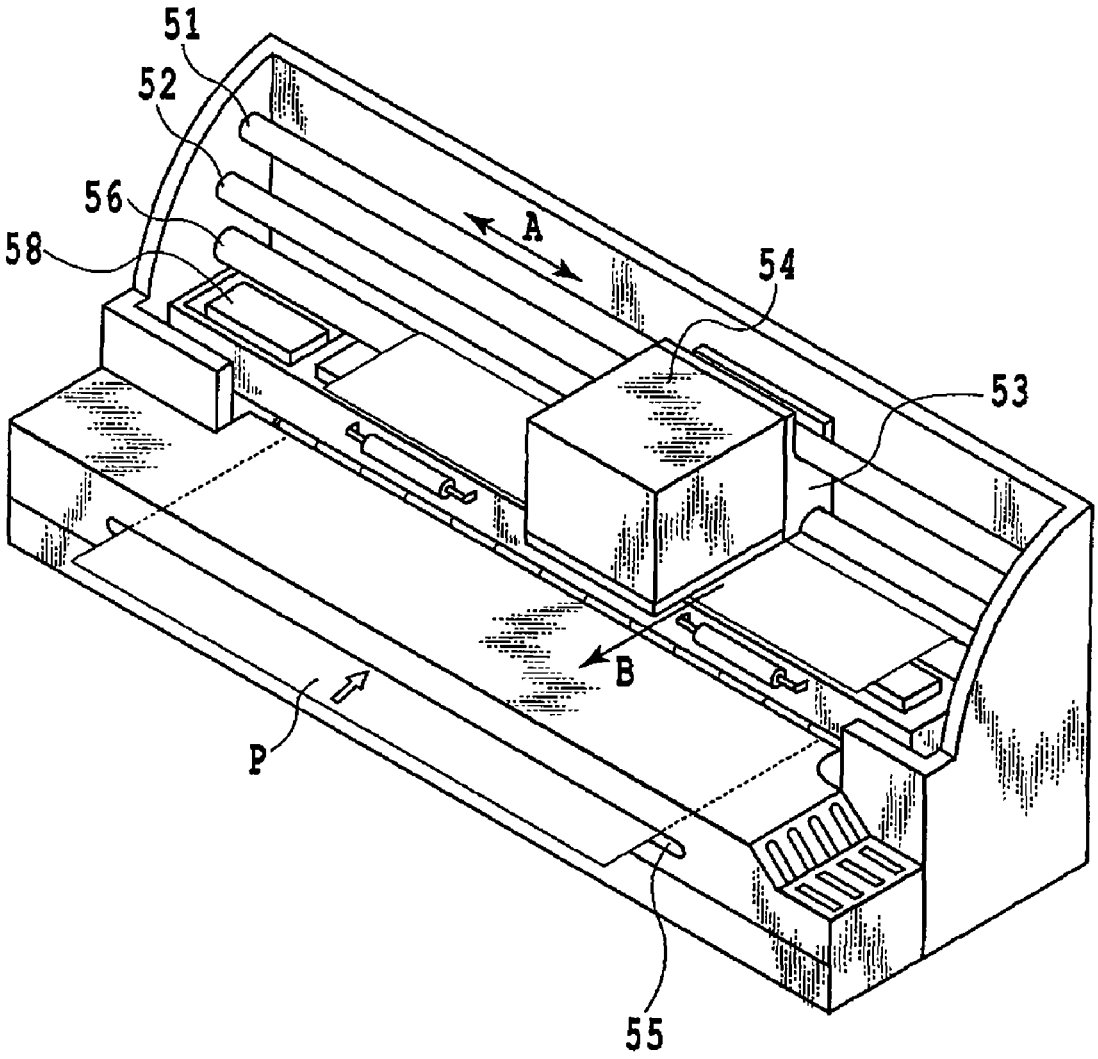
FIG. 8 is an outline perspective view showing an example image forming apparatus that can be applied to the present invention.

FIG. 8 is an outline perspective view showing an example construction of an image forming apparatus that can apply the present invention. The image forming apparatus of this example is an ink jet printing apparatus of serial scan type in which an ink cartridge 54 and an ink jet print head are removably mounted on a carriage 53 that reciprocally moves in a main scan direction of arrow A. The ink cartridge 54 accommodates ink as consumable. The ink jet print head can eject ink supplied from the ink cartridge 54 from a plurality of nozzles and use electrothermal transducers (heaters) and piezoelectric devices as a means for generating ink ejection energy. When the electrothermal transducers are used, a bubble is formed in ink by the heat of the electrothermal transducer and the expanding bubble expels the ink from the nozzle. The ink cartridge 54 may be one that forms an ink jet cartridge together with ink jet print head.

The carriage 53 is guided along guide shafts 51, 52 so that it can be moved in the main scan direction of arrow A. The carriage 53 is reciprocally moved in the main scan direction by a carriage motor and a drive force transmission mechanism such as a belt for transmitting the drive force of the motor. Paper P as a print medium, after being inserted into an insertion opening 55 provided at the front end of the apparatus, is inverted in its transport direction and fed by a feed roller 56 in a subscan direction of arrow B. The printing apparatus 50 repetitively alternates a printing operation and a feeding operation to print images successively on the paper P. The printing operation at this time involves ejecting ink toward a print area on the paper P on the platen 57 while moving the print head 10 in the main scan direction. The feeding operation feeds the paper P in the subscan direction a distance corresponding to a print width of the image printed by the printing operation.

At a left end of the travel range of the carriage 53 in FIG. 8 is installed a recovery system unit (recovery processing means) 58 that faces a nozzle forming surface of the print head 10 mounted on the carriage 53. The recovery system unit 58 is provided with a cap capable of capping the nozzles and a suction pump capable of introducing a negative pressure into the cap. The recovery system unit 58 introduces the negative pressure into the cap, that closes the nozzles, to suck out ink from the nozzles to maintain the good ink ejection state of the print head 10 (this recovery operation is also called a "suction-based recovery operation"). Further, the recovery operation to maintain the good ink ejection state of the print head 10 can also be performed by ejecting ink that does not contribute to forming images from the nozzles into the cap.

Figure 1:
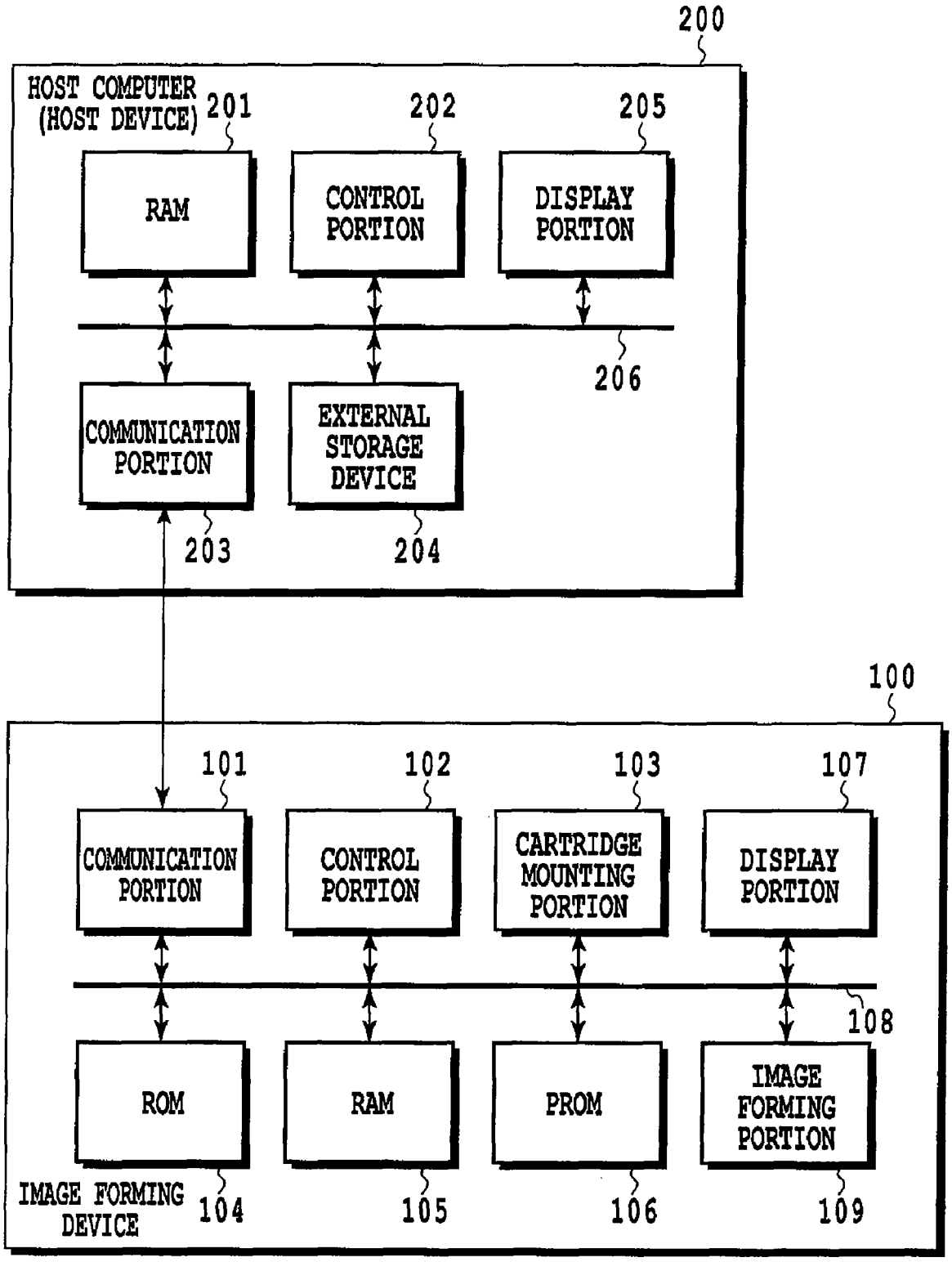
FIG. 1 is an outline block diagram of an image forming apparatus in a first embodiment of this invention.

FIG. 1 is a block configuration diagram of a control system in the image forming apparatus 100 of this embodiment.

The image forming apparatus 100 can be constructed in a manner similar to the ink jet printing apparatus of FIG. 8. An image forming portion 109 in the image forming apparatus 100 executes an image forming operation. In the case of the ink jet printing apparatus of FIG. 8, the image forming portion 109 includes a mechanical portion required to print an image by causing the ink jet print head to eject ink as the print head moves relative to the paper P. The mechanical portion includes a carriage motor to drive the carriage 53 in the main scan direction, a paper feed motor to transport the paper P in the subscan direction, and a motor driver for these motors.

A communication portion 101 of the image forming apparatus 100 communicates with a host computer (host device) 200, such as a personal computer, and a digital camera through USB and IEEE 1394. A control portion 102 is a processor that controls the operation of the entire apparatus according to a control program stored in a ROM 104. The ROM 104 is a nonvolatile read only memory device and stores ID information of the image forming apparatus 100 and a control program to cause the control portion 102 to execute processing described later. A RAM 105 is a volatile memory device which is used as a work area by the control portion 102 during the execution of control processing and to temporarily store various data. A PROM 106 is a nonvolatile rewritable memory device and stores cartridge ID information described later.

A cartridge mounting portion 103 has a connector for a cartridge connecting terminal 302 of a cartridge C described later to read and write information to and from a storage device 301 of the cartridge C. In the case of the ink jet printing apparatus of FIG. 8, the ink cartridge 54 is equivalent to the cartridge C and the cartridge mounting portion 103 is equivalent to the ink cartridge 54 mounting portion in the carriage 53.

A display portion 107 informs the user of the state of the image forming apparatus by means of LED and liquid crystal panel. The communication portion 101, control portion 102, cartridge mounting portion 103, ROM 104, RAM 105, PROM 106, display portion 107 and the image forming portion 109 communicate through a common bus 108. The ROM 104 may be eliminated and its function may be covered by the PROM 106. The information that can be stored in the ROM 104 may all be stored in the PROM 106.

A host computer 200 has a RAM 201, a control portion 202, a communication portion 203, an external storage device 204 and a display portion 205, all interconnected through a bus 206.

Figure 2:
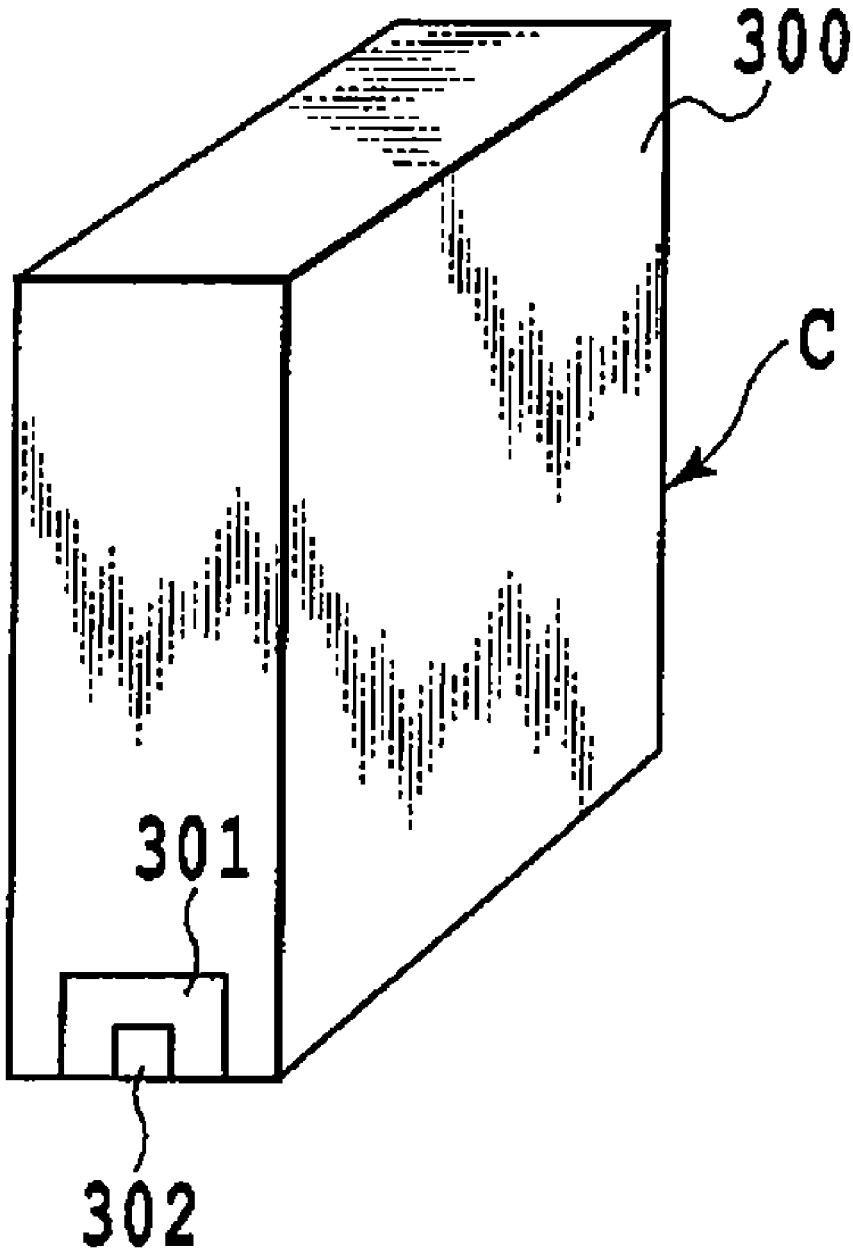
FIG. 2 is an outline perspective view of a cartridge that can be mounted on the image forming apparatus of FIG. 1.

FIG. 2 is a perspective view showing an outline construction of the cartridge C in this embodiment. The cartridge C accommodates consumables, such as ink and print medium. The cartridge C of this example is an ink cartridge accommodating ink as with the ink cartridge 54 of FIG. 8.

The cartridge C of this example has a body 300 accommodating ink and a storage device 301, such as IC chip, to store information. The storage device 301 is connected with a cartridge connecting terminal 302 that can be connected to the cartridge mounting portion 103 of the image forming apparatus 100. Information exchange between the storage device 301 and the image forming apparatus 100 may also be realized by using a noncontact type radio-based communication means, rather than the above-described contact type communication means.

Figure 3A:
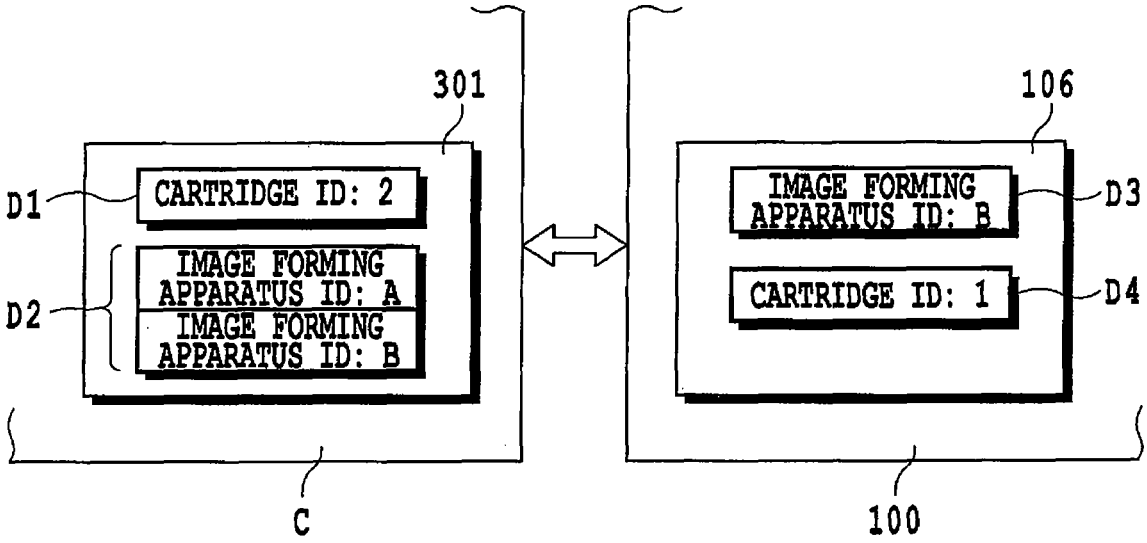
FIG. 3A and FIG. 3B illustrate a relation between the image forming apparatus of FIG. 1 and data stored in the cartridge of FIG. 2.
Figure 3B:
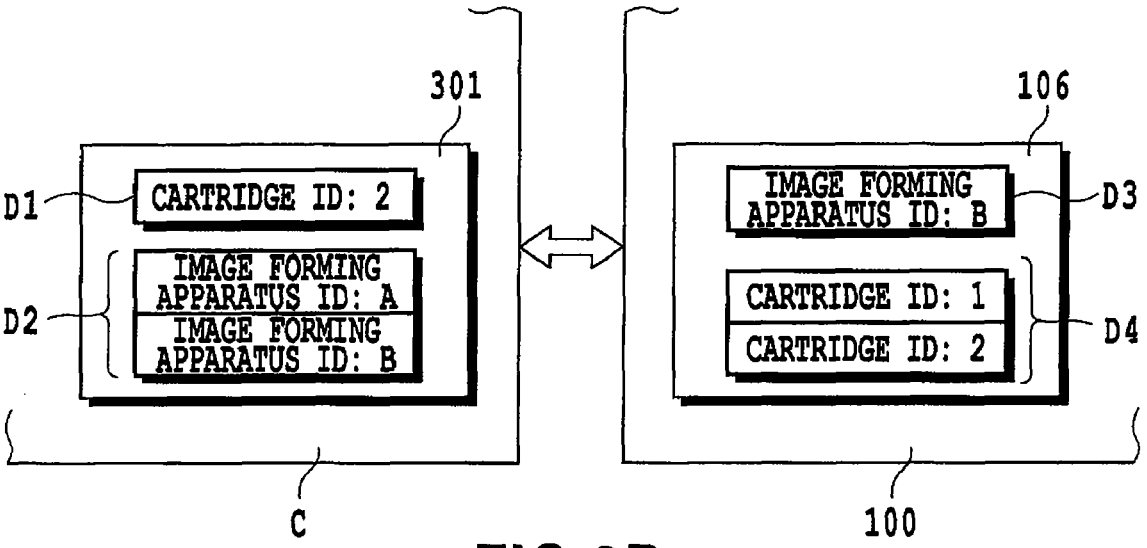

FIG. 3A and FIG. 3B show information stored in the PROM 106 of the image forming apparatus 100 and in the storage device 301 of the cartridge C.

The PROM 106 has written therein ID information (third information) D3 of the image forming apparatus 100 itself and ID information (fourth information) D4 of at least one cartridge C that can be used in the image forming apparatus 100. In FIG. 3A and FIG. 3B, "B" is written as the ID information (third information) D3 of the image forming apparatus 100. As the ID information (fourth information) D4 of the cartridge C that can be used on the image forming apparatus 100, "1" is written in the PROM 106 of FIG. 3A and "1" and "2" are written in the PROM 106 of FIG. 3B. The image forming apparatus 100 is shipped with the ID information D3, D4 written into the PROM 106 as described above. There is a case where the ID information D3 of the image forming apparatus 100 does not need to be rewritten. In that case, the ID information may be stored in the ROM 104 (see FIG. 1).

The storage device 301 of the cartridge C has ID information (first information) D1 of the cartridge itself and ID information (second information) D2 of at least one image forming apparatus 100 that can use that cartridge C. In FIG. 3A and FIG. 3B, "2" is written as the ID information (first information) of the cartridge C, and "A" and "B" are written as the ID information (second information) of the image forming apparatus 100 that can use the cartridge C. The cartridge C is shipped with the ID information D1, D2 written into the storage device 301.

In this example, ID information D1 of the cartridge itself and ID information D2 of at least one image formation apparatus 100 that can use the cartridge C are stored in the storage device 301 of the cartridge C. ID information D1, D2 may be barcode, such as two-dimensional barcode, attached to the cartridge, that can be read by an optical sensor. The present invention is also practicable in this case. Further, the present invention is practicable in a case in which ID information D1, D2 are coded in alphanumeric characters and printed on a package (outer case) of the cartridge. The alphanumeric characters are input by using an operating portion of the image formation apparatus by user, and processing shown in FIGS. 4 and 5 described later are performed for input alphanumeric characters as ID information D1, D2.

Figure 4:
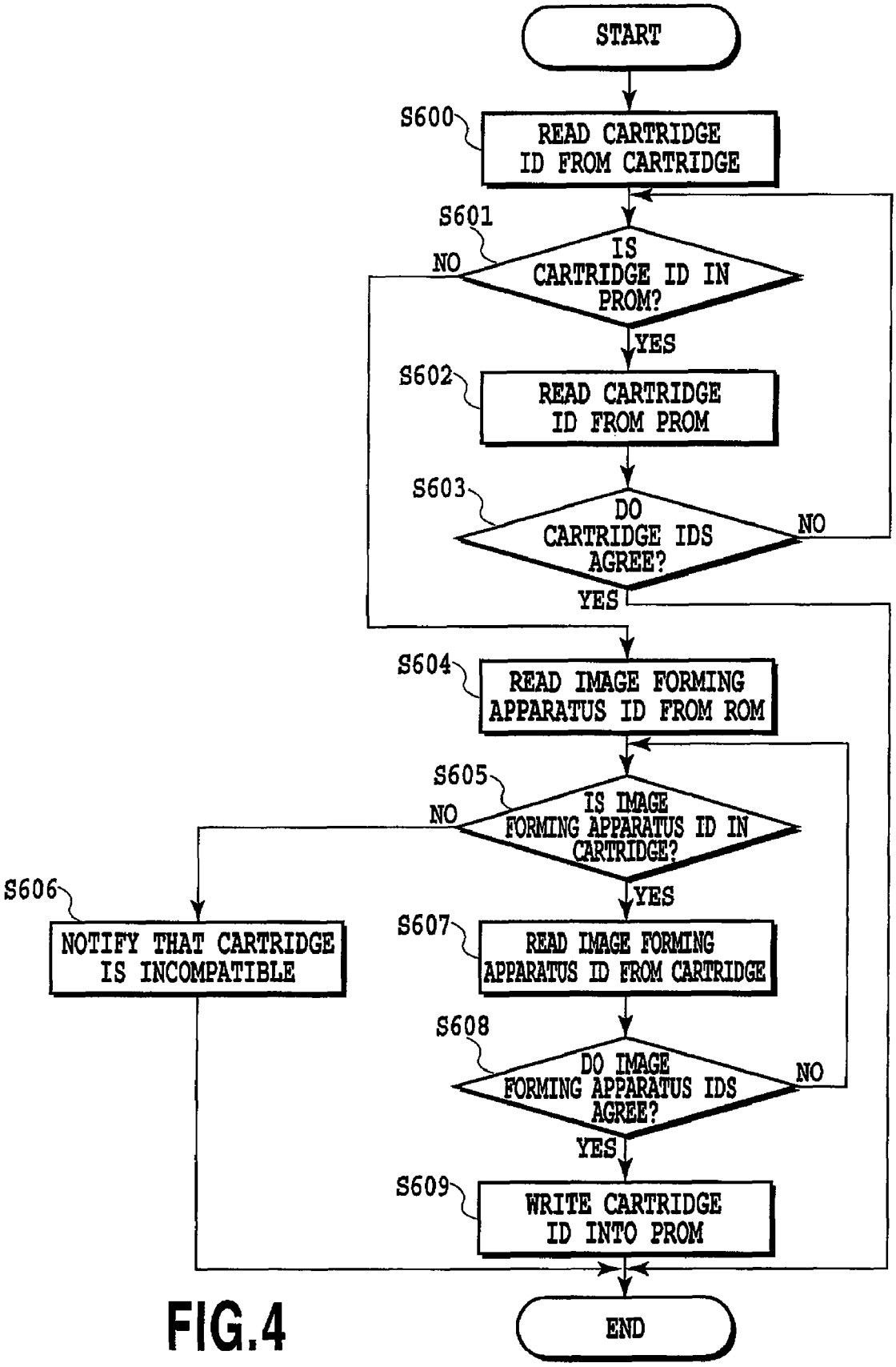
FIG. 4 is a flow chart showing a cartridge identifying process in the first embodiment of this invention.

FIG. 4 is a flow chart showing example processing in this embodiment to identify a cartridge. This identification processing is executed by the control portion 102 according to the control program stored in the ROM 104 of the image forming apparatus 100.

First, in step S600 the image forming apparatus 100 reads from the cartridge C mounted in the cartridge mounting portion 103 ID information (cartridge ID) as the first information D1 that is stored in the storage device 301. In step S601, a check is made as to whether the cartridge ID (fourth information D4) is stored in the PROM 106 of the image forming apparatus 100. If it is stored there, the cartridge ID (fourth information D4) is read out from the PROM 106 (step S602). Then, a decision is made as to whether the cartridge ID (fourth information D4) read from the PROM 106 agrees with the cartridge ID (first information D1) of the cartridge C (step S603). If they agree, the image forming apparatus 100 now can use the cartridge C mounted thereon. Therefore, in this case the identification processing is terminated.

In the decision of step S603, if the cartridge IDs fail to agree, the processing returns to step S601 where it checks if there is any cartridge ID (fourth information D4) that has yet to be read out. If there is any cartridge ID (fourth information D4) remaining to be read out, the cartridge ID is read out and then the processing of step S602 and S603 is executed. If there is no cartridge ID yet to be read out, ID information (image forming apparatus ID (third information D3)) of the image forming apparatus 100 itself is read out as the third information D3 from the ROM 104 of the image forming apparatus 100 (step S604).

In the next step S605, it is checked whether an image forming apparatus ID (second information D2) is stored in the storage device 301 of the cartridge C. If the image forming apparatus ID is stored, it is read out (step S607) to determine whether the image forming apparatus ID (second information D2) agrees with the image forming apparatus ID (third information D3) read out from the ROM 104 of the image forming apparatus 100 (step S608). If they agree, the image forming apparatus 100 is allowed to use the cartridge C mounted thereon. In this case, the processing proceeds to step S609 where it writes the cartridge ID of the cartridge C as the fourth information D4 into the PROM 106 of the image forming apparatus 100 before ending this identification processing.

If, for example, the relation between the image forming apparatus 100 and the cartridge C is as shown in FIG. 3A, the cartridge ID "2" of the cartridge that can be used is not stored in the fourth information D4 of the PROM 106 of the image forming apparatus. However, the second information D2 of the storage device 301 of the cartridge C is written with the image forming apparatus ID "B" of the image forming apparatus that can use that cartridge C. In such a case, in the image forming apparatus 100 having "B" as the image forming apparatus ID, step S608 decides that the apparatus 100 can use the cartridge C with its ID of "2". Then, step S609, as shown in FIG. 3B, writes a new cartridge ID of "2" into the fourth information D4 of PROM 106 of the image forming apparatus 100.

If the image forming apparatus IDs fail to agree in the decision of step S608, the processing returns to step S605 and checks if there is any image forming apparatus ID (second information D2) that has yet to be read out. If there is any image forming apparatus ID remaining to be read out, the ID is read out and then steps S607 and S608 are executed. If there is no ID remaining to be read out, the cartridge C mounted on the image forming apparatus 100 cannot be used in that apparatus. In this case, the identification processing informs the user of the image forming apparatus 100, before exiting the processing, that the installed cartridge C is not compatible with the image forming apparatus 100. The method of notification in that case may involve, for example, blinking an LED on the display portion 107 in a manner different from the normal one or displaying character strings on a liquid crystal panel.

Second Embodiment

The image forming apparatus of the first embodiment is so constructed as to be able to check if a variety of kinds of cartridges including new cartridges can be used or not. Further, without changing such a basic construction, it is possible to prompt the user to update software (driver) that instructs the image forming apparatus to perform the image forming operation. Cartridges having IDs different from those of conventionally used cartridges are often those cartridges (such as ink cartridges) accommodating consumables with different characteristics from the conventional ones. Such a case mostly requires a printer driver (software) different from that of the conventional cartridge. Normally, the printer driver is installed in the host computer 200 and is used to control the image forming apparatus 100.

Figure 5:
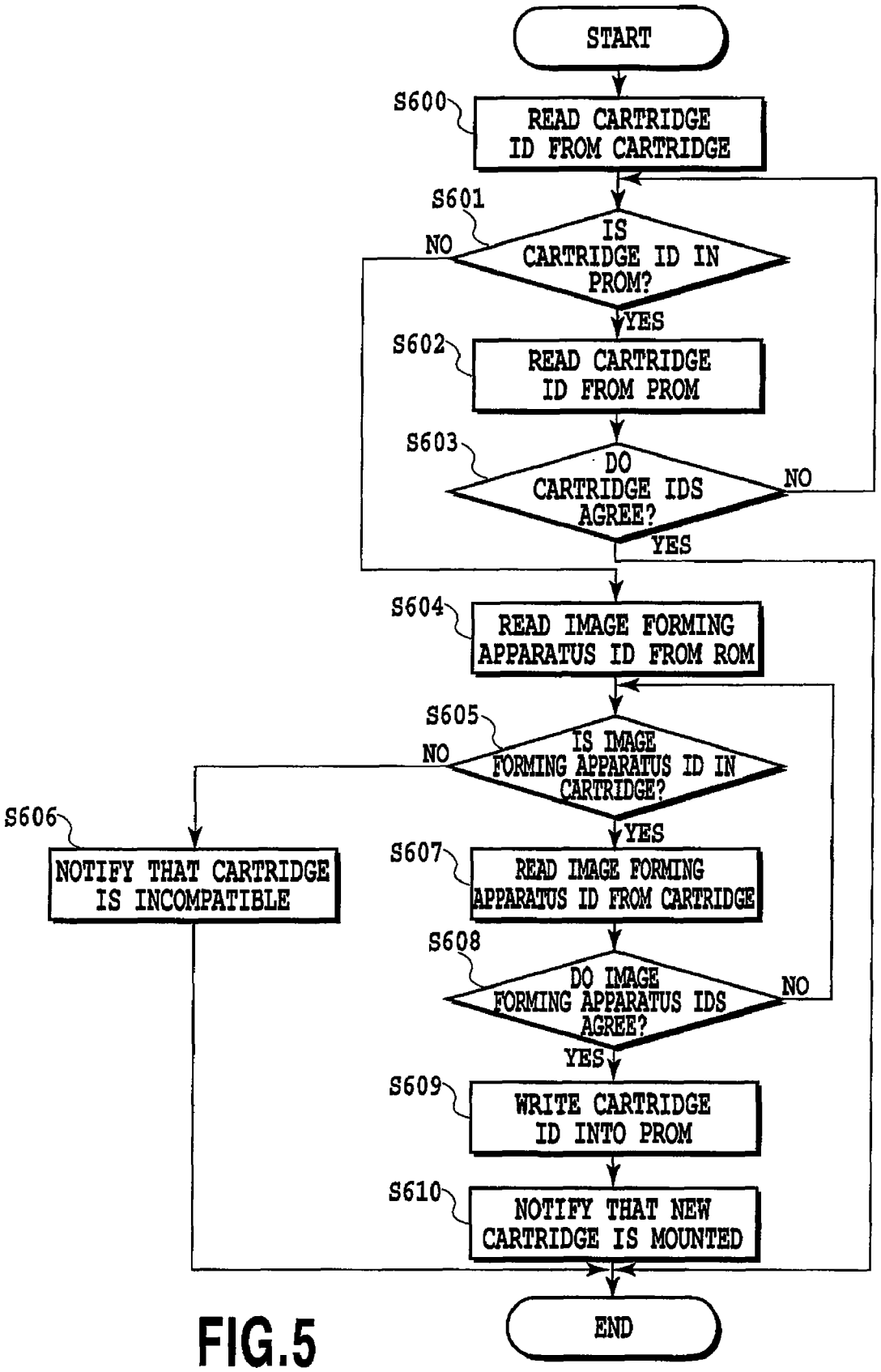
FIG. 5 is a flow chart showing a cartridge identifying process in a second embodiment of this invention.

FIG. 5 is a flow chart showing an example of cartridge identification processing in the second embodiment of this invention.

Steps from S600 to S609 are the same as those of the first embodiment. In this embodiment, step S610 following step S609 causes the image forming apparatus 100 to notify the host computer 200 connected to the communication portion 101 of the apparatus 100 that a new cartridge has been mounted on the image forming apparatus 100. That is, when, with the cartridge mounted, a new cartridge ID is written into the PROM 106 (step S609), the cartridge is recognized as a new cartridge and information indicating this fact is informed to the host computer 200.

Figure 6:
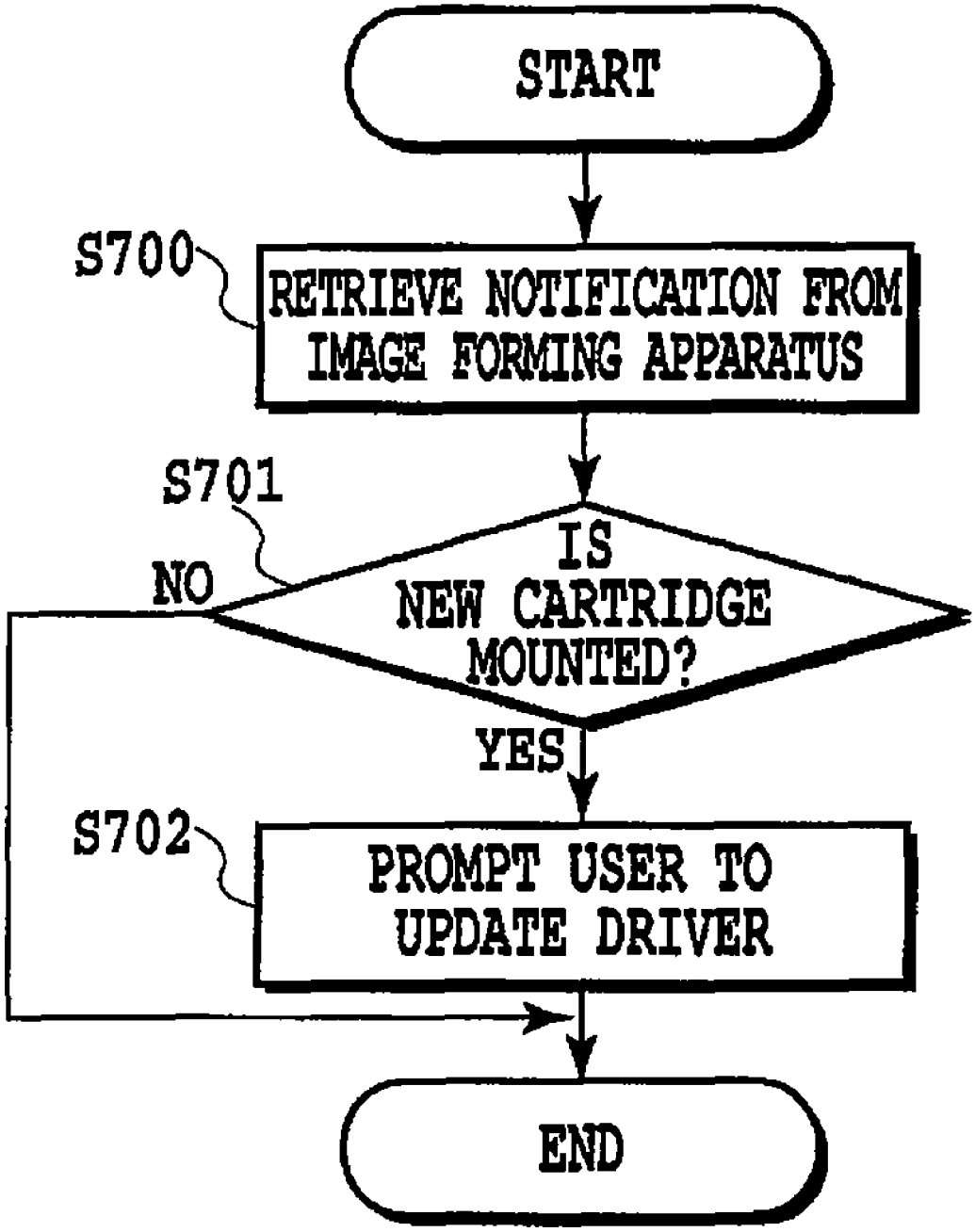
FIG. 6 is a flow chart showing processing executed by a host computer in the second embodiment of this invention.

FIG. 6 is a flow chart showing example processing that the host computer performs when it receives the above notification.

Figure 7:
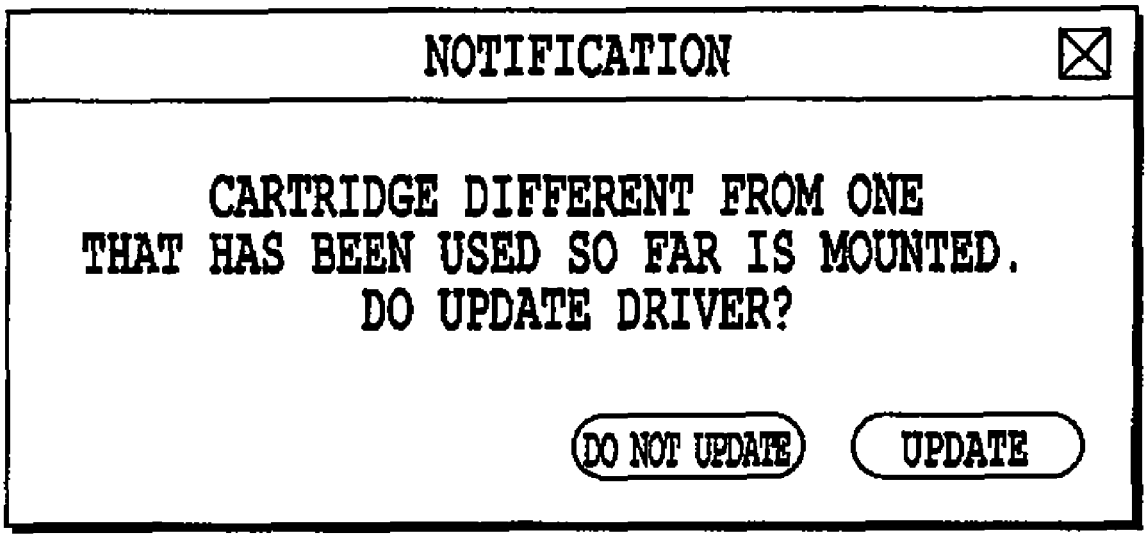
FIG. 7 illustrates an example of content shown on a display portion during the processing of FIG. 6.

First, in step S700 the computer receives information notified by the communication portion 203 of the image forming apparatus 100. Then, it checks if the notified information indicates that a new cartridge has been mounted (step S701). If the notified information indicates the mounting of a new cartridge, the computer prompts by the display portion 205 the user to update the printer driver (step S702). FIG. 7 shows an example notification prompting the user to update the printer driver. When a dialog, such as shown in FIG. 7, is displayed and if the user selects a button representing "update", a Web browser such as Internet Explorer and Netscape is started to display a Web page to download the printer driver. The user can download the printer driver from the Web page to the host computer 200.

The procedure of FIG. 6 is stored as software in the external storage device 204 of the host computer 200 and is read out by the control portion 202 into the RAM 201 and then executed by the control portion 202.

Other Embodiments

In the above embodiments, the cartridge ID of a new cartridge that has been verified to be compatible or usable is written into the PROM of the image forming apparatus in order to simplify the subsequent identification processing. However, a person skilled in the art will understand that this writing operation is not always necessary. That is, the operation to write the cartridge ID of the new cartridge which is verified to be usable into the PROM of the image forming apparatus is simply an option.

The present invention can be applied widely to various kinds of apparatus to which a cartridge can be mounted. The cartridges may be those that accommodate various kinds of consumables. For example, they may be an ink cartridge accommodating ink and a cartridge accommodating print paper. Not only can the cartridges accommodate the consumables used in the image forming apparatus (printing apparatus), but it they may also be components that store information (including program and data) used in the image forming apparatus.

Further, this invention is not limited to only the serial scan type printing apparatus described above but may be applied to a variety of image forming apparatus. The printing method is not limited to only the ink jet method and may be of any type.

The present invention can be widely applied to an information processing system comprised of a plurality of devices such as a host computer and an image forming apparatus, and to an information processing system comprised of a single device such as an image forming device. More specifically, the present invention can be applied to scanners, printers, personal computers, copying machines, composite machines, and facsimiles. That is, the present invention can be applied widely to various kinds of apparatus equipped with a cartridge.

The present invention can also be realized by other methods than executing the control program stored in the ROM 104 of the image forming apparatus 100 by the control portion 102. For example, a computer incorporated into the image forming apparatus 100 or a host computer (host device) 200, which together with the image forming apparatus 100 forms an image forming system, may read and execute program codes of software programs supplied from outside to realize the present invention. The software programs are those which realize individual functions of the embodiments described above (programs correspond to the flow charts shown in FIG. 4 and FIG. 6), and can be supplied directly or remotely to a system or apparatus. Therefore, the program codes themselves that are installed in a computer to implement the functions/processing of this invention by the computer are among the constitutional elements of this invention. That is, the computer programs themselves to implement the functions/processing form one invention. In that case, the programs may be in any form, for example, object codes, programs executed by an interpreter, or script data to be supplied to an operating system.

Storage medium that may be used to supply the programs include, for example, flexible disks, hard disks, optical discs, magnetooptical discs, MOs, CD-ROMs, CD-Rs, CD-RWs, magnetic tapes, nonvolatile memory cards, ROMs, and DVDs (DVD-ROMs and DVD-Rs).

Other methods for supplying programs include connecting to a home page on the Internet by using a browser of a client computer. In that case, computer programs of this invention or compressed files including an automatic install function can be downloaded from a connected home page into storage medium such as hard disk. It is also possible to divide program codes making up the programs of this invention into a plurality of files and to download these files from different home pages. That is, WWW servers that allow the program files, used to realize processing functions of this invention by the computer, to be downloaded to a plurality of users also form constitutional elements of this invention.

The processing functions of this invention can also be realized by encrypting the programs of this invention, storing the encrypted programs in storage medium, such as CD-ROMs, and distributing them to users. In that case, users who have cleared predetermined conditions are allowed to download decryption key information from the home page through the Internet and use that decryption key information to execute the encrypted programs and thereby install them in the computer.

In addition to executing by the computer the program read out, the functions of this invention can also be realized by the operating system on the computer executing a part or all of the actual processing according to instructions of that program.

Further, it is also possible to use a memory in a function expansion board inserted in the computer or a memory in a function expansion unit connected to the computer. That is, after the program read out from the storage medium is written into these memories, the CPU in the function expansion board or function expansion unit executes a part or all of the actual processing according to instructions of the program. This processing can also realize the functions of this invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-260871, filed Sep. 8, 2005, which is hereby incorporated by reference herein in its entirety.

What is claimed is:

1. A decision method performed by a processor to check if a component mounted in an image forming apparatus can be used in the image forming apparatus, the method comprising the steps of:

recognizing first and second information provided to the component, the first information being identification information of the component, the second information being identification information of at least one image forming apparatus that can use the component and being provided to the component before the component is mounted on the image forming apparatus;

comparing the first and second information with third and fourth information stored in the image forming apparatus, the third information being identification information of the image forming apparatus, the fourth information being identification information of at least one component that can be used in the image forming apparatus;

deciding that, when the fourth information includes the first information or when the second information includes the third information, the component mounted on the image forming apparatus can be used; and deciding that, when the fourth information does not include the first information and the second information does not include the third information, the component mounted on the image forming apparatus cannot be used.

2. A decision method according to claim 1, wherein the first and second information are stored in a storage portion of the component, and wherein the recognizing step recognizes the first and second information read out from the storage portion of the component.

3. A control program stored in a computer-readable medium to check if a component mounted on an image forming apparatus can be used or not, the control program causing a computer to execute the steps of:

recognizing first and second information provided to the component, the first information being identification information of the component, the second information being identification information of at least one image forming apparatus that can use the component and being provided to the component before the component is mounted on the image forming apparatus;

comparing the first and second information with third and fourth information stored in the image forming apparatus, the third information being identification information of the image forming apparatus, the fourth information being identification information of at least one component that can be used in the image forming apparatus;

deciding that, when the fourth information includes the first information or when the second information includes the third information, the component mounted on the image forming apparatus can be used; and deciding that, when the fourth information does not include the first information and the second information does not include the third information, the component mounted on the image forming apparatus cannot be used.

4. A control program according to claim 3, wherein, when it is decided that the fourth information does not include the first information, the control program causes the computer to execute a step of checking if the second information includes the third information.

5. A control program according to claim 3, wherein, when the fourth information does not include the first information and the second information includes the third information, the control program causes the computer to execute a step of storing the first information in the image forming apparatus so as to add the first information to the fourth information.

6. A control program according to claim 3, wherein, when it is decided that the component cannot be used, the control program causes the computer to execute a step of notifying that software for using the component needs to be updated.

7. A control program according to claim 3, wherein the first and second information are stored in a storage portion of the component, and wherein the recognizing step recognizes the first and second information read out from the storage portion of the component.

* * * * *